US008002009B2

(12) United States Patent
Anderson

(10) Patent No.: US 8,002,009 B2
(45) Date of Patent: Aug. 23, 2011

(54) APPLICATION TOOL FOR MULTIPLE WIDTH FILMS

(75) Inventor: Gordon L. Anderson, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 1012 days.

(21) Appl. No.: 10/595,213

(22) PCT Filed: Sep. 30, 2004

(86) PCT No.: PCT/US2004/032033

§ 371 (c)(1),
(2), (4) Date: Feb. 7, 2007

(87) PCT Pub. No.: WO2005/032991

PCT Pub. Date: Apr. 14, 2005

(65) Prior Publication Data

US 2007/0267122 A1 Nov. 22, 2007

(51) Int. Cl.
*B29C 65/50* (2006.01)
*B32B 37/26* (2006.01)
*B32B 39/00* (2006.01)

(52) U.S. Cl. ..... 156/391; 156/538; 156/574

(58) Field of Classification Search ..... 156/71, 156/166, 538, 556, 574
See application file for complete search history.

(56) References Cited

U.S. PATENT DOCUMENTS

| | | | | |
|---|---|---|---|---|
| 6,508,287 | B1 | 1/2003 | Shinozaki et al. | |
| 6,585,023 | B2 | 7/2003 | Azuhata | |
| 6,601,630 | B2 * | 8/2003 | Kang | 156/574 |
| 6,698,489 | B1 | 3/2004 | Shinozaki et al. | |
| 6,748,993 | B1 | 6/2004 | Shinozaki et al. | |
| 7,152,651 | B2 * | 12/2006 | Fujiwara | 156/574 |

FOREIGN PATENT DOCUMENTS

| | | | |
|---|---|---|---|
| EP | 1 211 136 | A2 | 6/2002 |
| EP | 1 211 136 | A3 | 6/2002 |
| JP | 2001-171570 | | 6/2001 |
| JP | 2001-328573 | | 11/2001 |
| JP | 2002-167110 | | 6/2002 |
| JP | 2003205923 | A * | 7/2003 |
| JP | 2001-97636 | | 4/2004 |
| WO | WO 03/062109 | A1 | 7/2003 |
| WO | WO 03/091139 | A1 | 11/2003 |

* cited by examiner

*Primary Examiner* — Philip C Tucker
*Assistant Examiner* — Sing P Chan

(57) ABSTRACT

An adhesive-backed film application tool (10) is provided for applying an adhesive-backed film (100) having at least first and second widths to a first surface (202) of a sash (200). The sash (200) further includes a second surface (204). The tool comprises (10): a directing structure (20) adapted to engage the second surface (204) of the sash (200); an application structure (30) pivotably coupled to the directing structure (20); and an element (40) for biasing the directing and application structures (20, 30) toward one another such that the directing and application structures (20, 30) are capable of being releasably clamped to the sash (200). The application structure (30) includes at least one rotatable element (37*a*, 37*b*) for applying the adhesive-backed film (100) to the first surface (202) and guide structure (160) for properly locating the adhesive-backed film relative to the rotatable element (37*a*, 37*b*) and the first surface (202). The guide structure (160) has a movable guide surface (172*a*) capable of being located in a first position corresponding to the first width (w1) of the adhesive-backed film (100) and a second position corresponding to the second width (w2) of the adhesive-backed film (100).

7 Claims, 13 Drawing Sheets

APPLICATION TOOL FOR MULTIPLE WIDTH FILMS

FIELD OF THE INVENTION

The present invention relates to processes and apparatus for applying an adhesive-backed film or tape on the outer face of, for example, automobile door window frames or sashes and, wherein, the film or tape comprises multiple widths.

BACKGROUND OF THE INVENTION

A thin film or tape may be applied to the surface of an article to provide the article with a favorable design. It is known in the art that it is difficult to precisely position and adhere an adhesive-backed film onto an article. Further, it is difficult to apply the film without air becoming entrapped between the film and the article during the application process. It is also noted that if the step of applying the film is not continuous, a line mark (a shock line) may be formed in the film. Such a shock line impairs the external appearance of the film/article combination.

Some automobile assembly lines apply a thin film (e.g., a narrow width paint replacement film) onto automobile surfaces. More specifically, for example, a black adhesive tape (i.e., an adhesive-backed paint replacement film) may be applied to a vehicle sash so as to improve the appearance of the vehicle. The black adhesive tape, for example, comprises a film layer (made of vinyl chloride, for example) as a substrate and an adhesive layer (an acrylic-type pressure sensitive adhesive, for example) provided on the backside of the film layer.

It would be desirable to have a tool and related process for applying an adhesive-backed film having multiple widths, e.g., a first section having a first width and a second section having a second width, such that the multiple width film may be applied without shock lines resulting in the applied film or air becoming trapped between the film and the article.

SUMMARY OF THE INVENTION

In accordance with the present invention, a tool and related process are provided for applying an adhesive-backed film or tape (e.g., die cut shapes of blackout film or tape) having multiple widths, e.g., a first section having a first width and a second section having a second width, to the outer face of, for example, an automobile door window frame or sash.

In accordance with a first aspect of the present invention, an adhesive-backed film application tool is provided for applying an adhesive-backed film to a first surface of an adherend. The adherend further includes a second surface. The tool comprises: a directing structure adapted to engage the second surface of the adherend; an application structure pivotably coupled to the directing structure; and an element for biasing the directing and application structures toward one another such that the directing and application structures are capable of being releasably clamped to the adherend. The application structure includes at least one element for applying the adhesive-backed film to the first surface and guide structure for properly locating the adhesive-backed film relative to the applying element and the first surface. The guide structure has a movable guide surface capable of being located in a first position corresponding to a first dimension of the adhesive-backed film and a second position corresponding to a second dimension of the adhesive-backed film.

In accordance with a second aspect of the present invention, an adhesive-backed film application tool is provided for applying an adhesive-backed film having at least first and second widths to a first surface of a sash. The sash further includes a second surface. The tool comprises: a directing structure adapted to engage the second surface of the sash; an application structure pivotably coupled to the directing structure; and an element for biasing the directing and application structures toward one another such that the directing and application structures are capable of being releasably clamped to the sash. The application structure includes at least one rotatable element for applying the adhesive-backed film to the first surface and guide structure for properly locating the adhesive-backed film relative to the rotatable element and the first surface. The guide structure has a movable guide surface capable of being located in a first position corresponding to the first width of the adhesive-backed film and a second position corresponding to the second width of the adhesive-backed film.

In accordance with a third aspect of the present invention, a process is provided for applying an adhesive-backed film having a first section with a first width and a second section with a second width to a first surface of a sash. The process comprises the steps of: clamping an adhesive-backed film application tool to the sash; and applying the adhesive-backed film to the first surface of the sash via at least one rotatable element of the tool. The tool includes a movable guide surface capable of being located in a first position corresponding to the first width of the adhesive-backed film and a second position corresponding to the second width of the adhesive-backed film. The process further comprises moving the guide surface from the first position to the second position approximately when the second section of the adhesive-backed film is to be applied to the sash first surface. The moving step may be conducted manually. Alternatively, the moving step may be effected automatically.

DETAILED DESCRIPTION OF THE INVENTION

Figure 1:
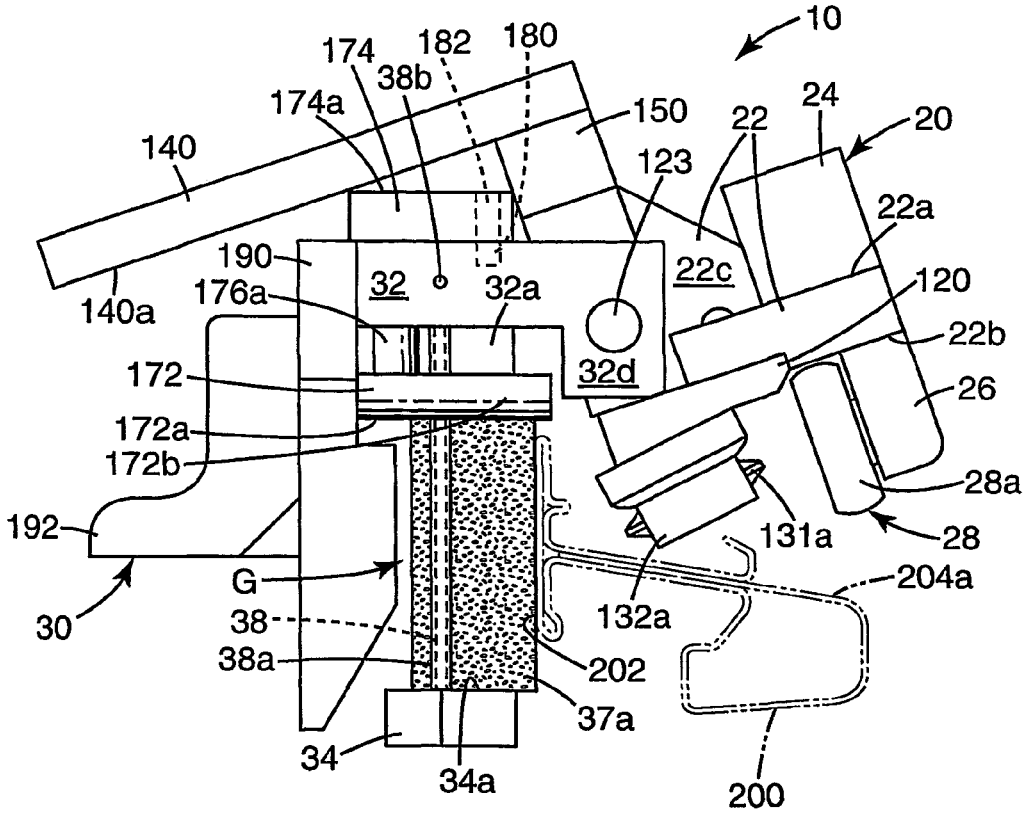
FIG. 1 is a side view of a tool constructed in accordance with a first embodiment of the present invention illustrating directing and application structures separated from one another just before the tool is clamped to a sash.
Figure 2:
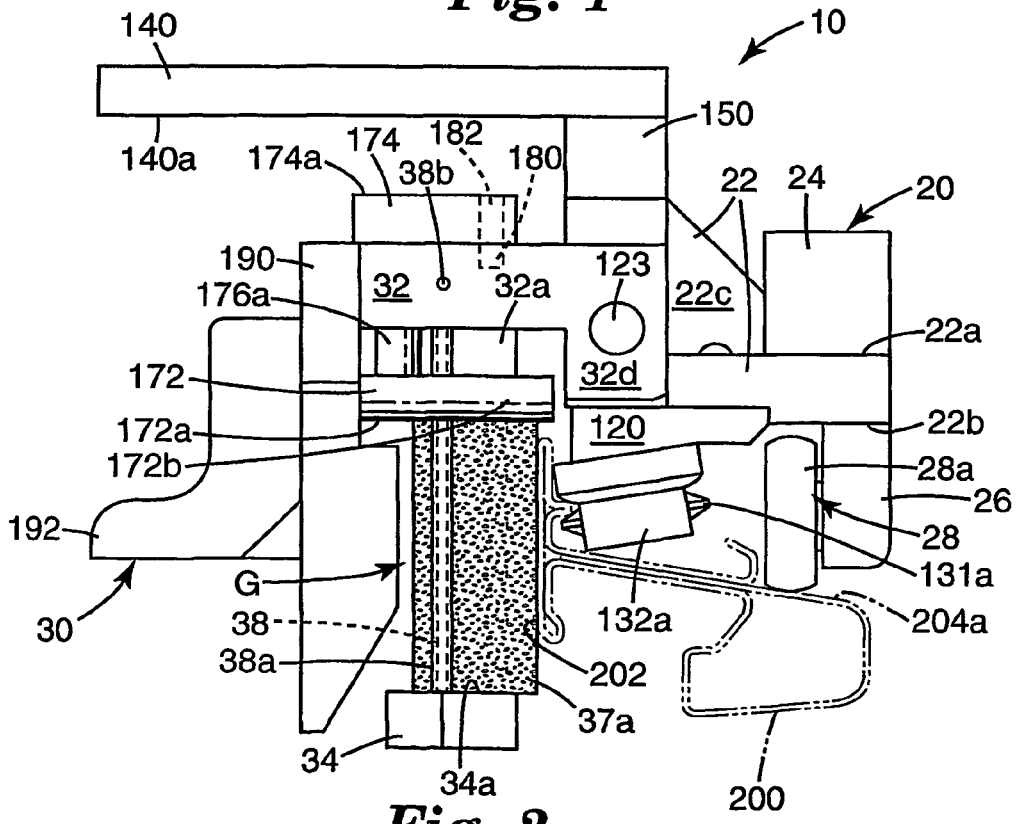
FIG. 2 is a side view of the tool of FIG. 1 illustrating the tool clamped to the sash and further illustrating a movable guide surface in a first position.
Figure 3:
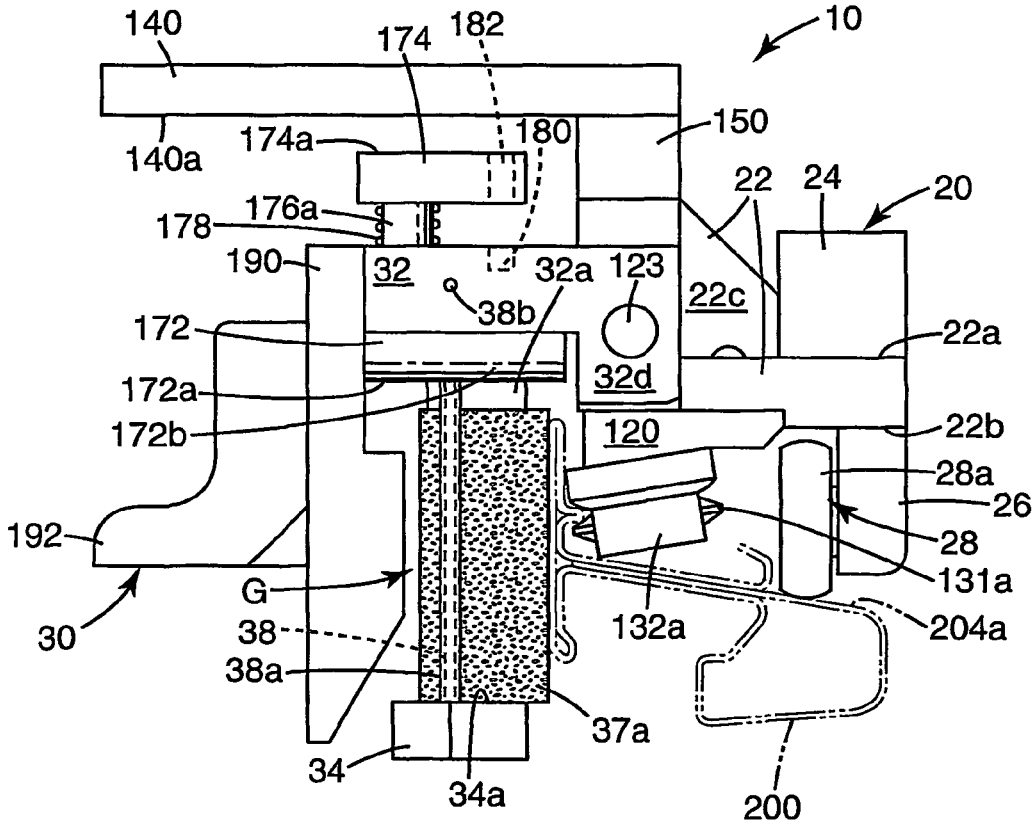
FIG. 3 is a side view of the tool illustrated in FIG. 1 illustrating the tool clamped to the sash and further illustrating the movable guide surface in a second position.
Figure 4:
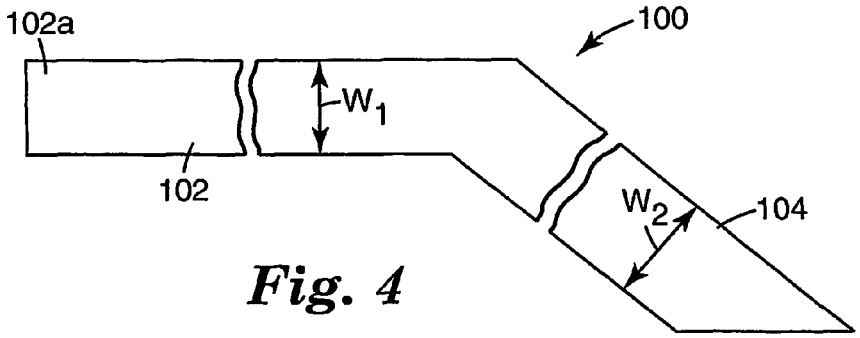
FIG. 4 is a side view of a film to be applied by the tool of FIG. 1 to a sash.
Figure 5:
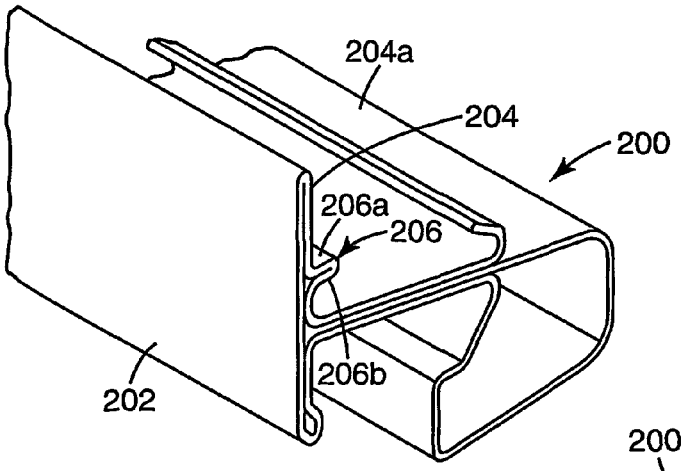
FIG. 5 is a perspective view of a portion of a sash to which a film may be applied by the tool of FIG. 1.
Figure 6:
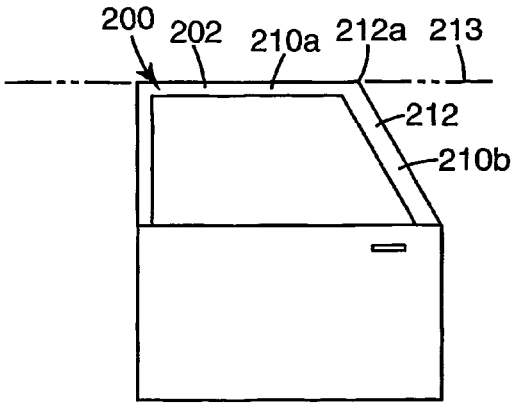
FIG. 6 is a side view of a door including the sash of FIG. 5.

Illustrated in FIGS. 1-3 is a tool 10 constructed in accordance with a first embodiment of the present invention for applying an adhesive backed film or tape 100 having multiple widths to an outer face of an adherend. The film 100 is illustrated in FIG. 4, but is not shown in FIGS. 1-3. In the illustrated embodiment, the film 100 comprises a first section 102 having a first width $W_1$ and a second section 104 having a second width $W_2$, which is greater in dimension than the first width $W_1$. Also in the illustrated embodiment, the adherend comprises a vehicle door frame or sash 200 having an outer, first surface 202 and an inner, second surface 204, see FIG. 5. The sash 200 further includes a projecting rib 206, which extends along the length of the sash 200 and to which a weather strip (not shown) is attached. As illustrated in FIG. 6, the sash 200 includes first and second substantially straight outer surface portions 210*a* and 210*b* and an angled outer surface portion 212. The second portion 210*b* has a width greater than the width of the first portion 210*a* The angled portion 212 has an outer corner 212*a*. The film first section 102 may be adhered to the sash first portion 210*a*, while the film second section 104 may be adhered to the sash second portion 210*b*.

The tool 10 comprises a directing structure 20 pivotably coupled to an application structure 30, see FIGS. 1-3, 7 and 8. The directing and application structures 20 and 30 are pivotably coupled together via a pin 123. A retainer clip 123*a* coupled to an end 123*b* of the pin 123 maintains the pin 123 in position relative to the directing and application structures 20 and 30. As will be discussed further below, a spring 40 is provided for biasing the directing and application structures 20 and 30 toward one another such that the tool 10 can be releasably clamped to the sash 200, see FIGS. 1, 2, 7 and 10.

Figure 7:
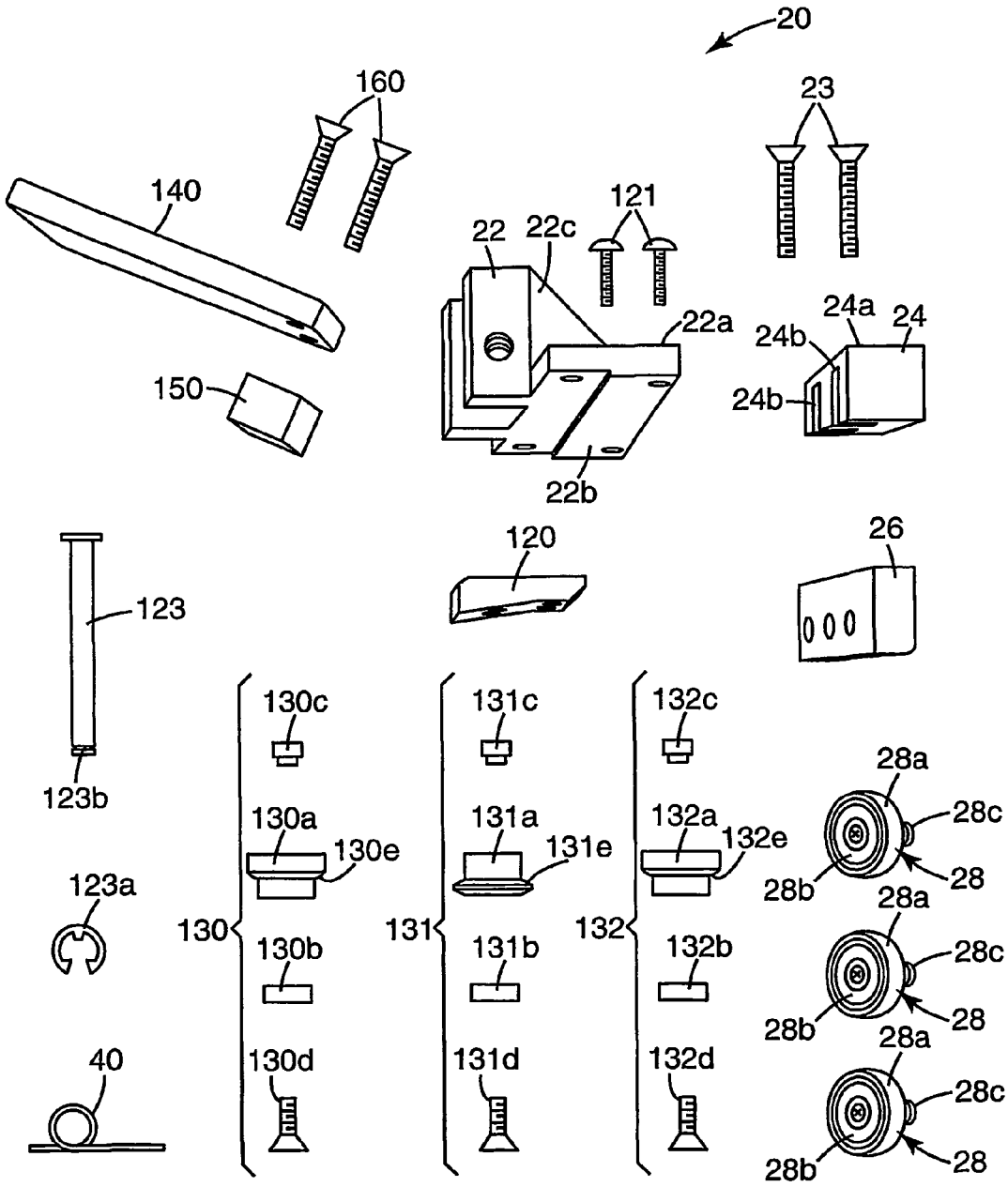
FIG. 7 is an exploded view of the directing structure of the tool of FIG. 1.

The directing structure 20 comprises a pivot block 22, see FIG. 7, where elements comprising the directing structure 20 are illustrated in exploded format. A grip block 24, having a tapered upper surface 24*a*, is mounted to an upper surface 22*a* of the pivot block 22. The grip block 24 includes a pair of recesses 24*b*, each sized to receive one of a pair of gussets 22*c* provided on the pivot block 22. A wheel block 26 is mounted to a lower surface 22*b* of the pivot block 22. Bolts 23 pass through bores in the grip block 24 and the pivot block 22 and are threadedly received in tapped openings in the wheel block 26. Three wheel assemblies 28 are provided, each including a wheel 28*a*, a bearing/hub structure 28*b* and a bolt 28*c*. The bolts 28*c* extend from the bearing/hub structures 28*b* and are received in corresponding tapped openings in the wheel block 26. As is apparent from FIGS. 2-3, the wheels 28*a* move along an edge portion 204*a* of the sash inner surface 204 and assist in stabilizing the tool 10 on the sash 200.

The directing structure 20 further comprises a flange roller mounting block 120, which is coupled to the pivot block 22 via bolts 121. The bolts 121 pass through bores in the pivot block 22 and are threadedly received in tapped openings in the mounting block 120. First, second and third flange guide roller assemblies 130-132 are coupled to the mounting block 120. Each guide roller assembly 130-132 comprises a corresponding roller 130*a*-132*a*, a corresponding bearing 130*b*-132*b*, a corresponding bearing spacer 130*c*-132*c* and a corresponding bolt 130*d*-132*d*. The bolts 130*d*-132*d* pass through the bearings 130*b*-132*b*, the rollers 130*a*-132*a* and the bearing spacers 130*c*-132*c* and are received in tapped openings provided in the mounting block 120. The rollers 130*a* and 132*a* of the first and third assemblies 130 and 132 have flanges 130*e* and 132*e*, which are similar in shape and size and engage a first side 206*a* of the projecting rib 206, while the roller 131*a* of the second assembly 131 has a flange 131*e* which engages a second side 206*b* of the projecting rib 206, see FIG. 2A. By engaging opposing sides 206*a*, 206*b* of the projecting rib 206, the flanges 130*e*-132*e* help mount the tool 10 to the sash 200 and further help guide the tool 10 as it is manually moved along the length of the sash 200 so as to apply a film 100 to the sash first surface 202. A discussion of similar guide roller assemblies is set out in International Publication WO 03/091139 A1, published on Nov. 6, 2003, which is incorporated herein by reference in its entirety, based on International Application No. PCTJUS03/09263, filed Mar. 27, 2003, entitled ADHESIVE TAPE APPLICATION TOOL, which is incorporated herein by reference in its entirety, and which, in turn, is based on Japanese priority patent application number 2002-123403 filed Apr. 25, 2002.

The directing structure 20 still further comprises a lever 140 and a lever spacer block 150. Bolts 160 pass through corresponding bores in the lever 140 and lever spacer block 150 and are threadedly received in corresponding tapped bores in the pivot block 22.

Figure 8:
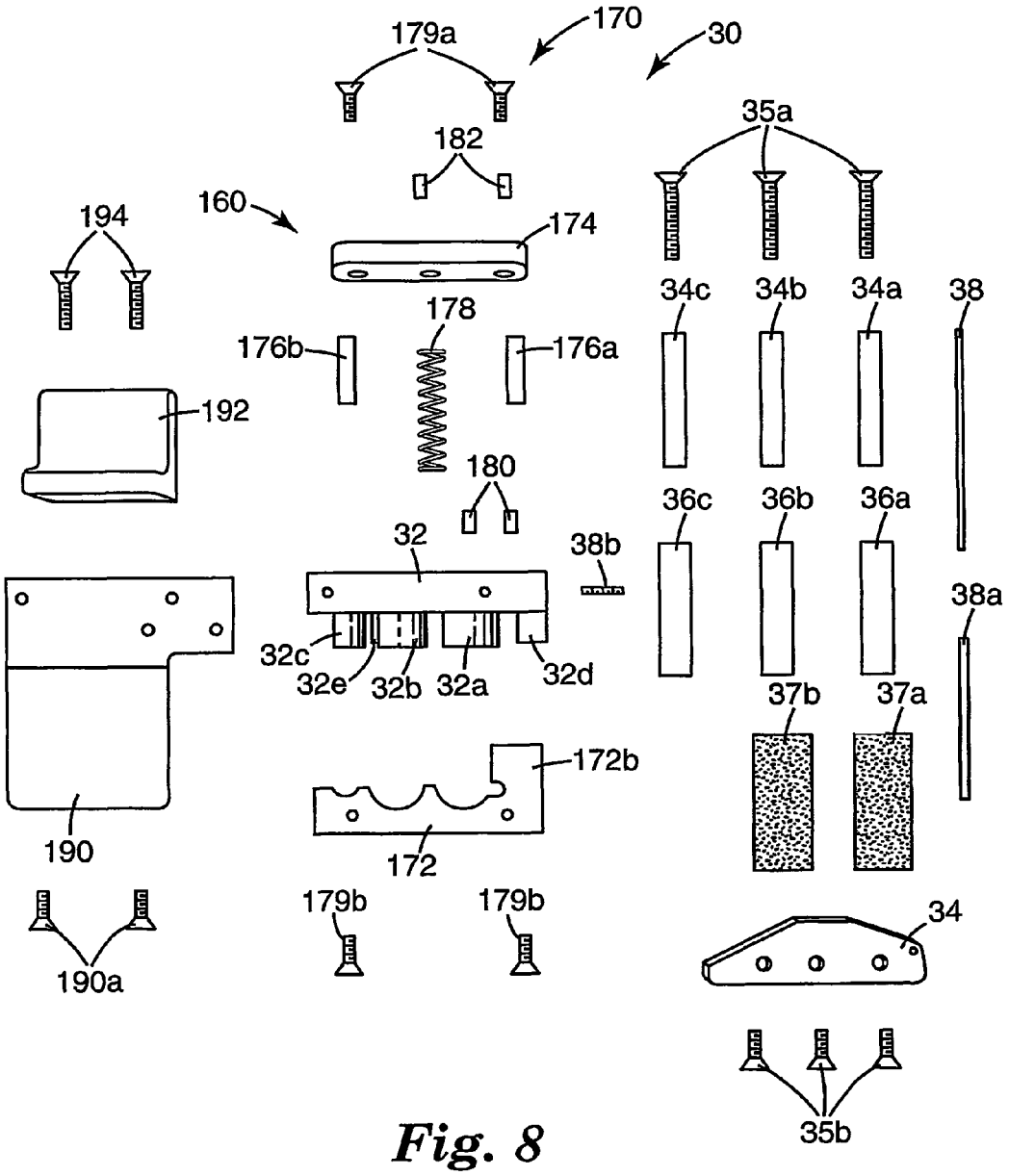
FIG. 8 is an exploded view of the application structure of the tool of FIG. 1.
Figure 9:
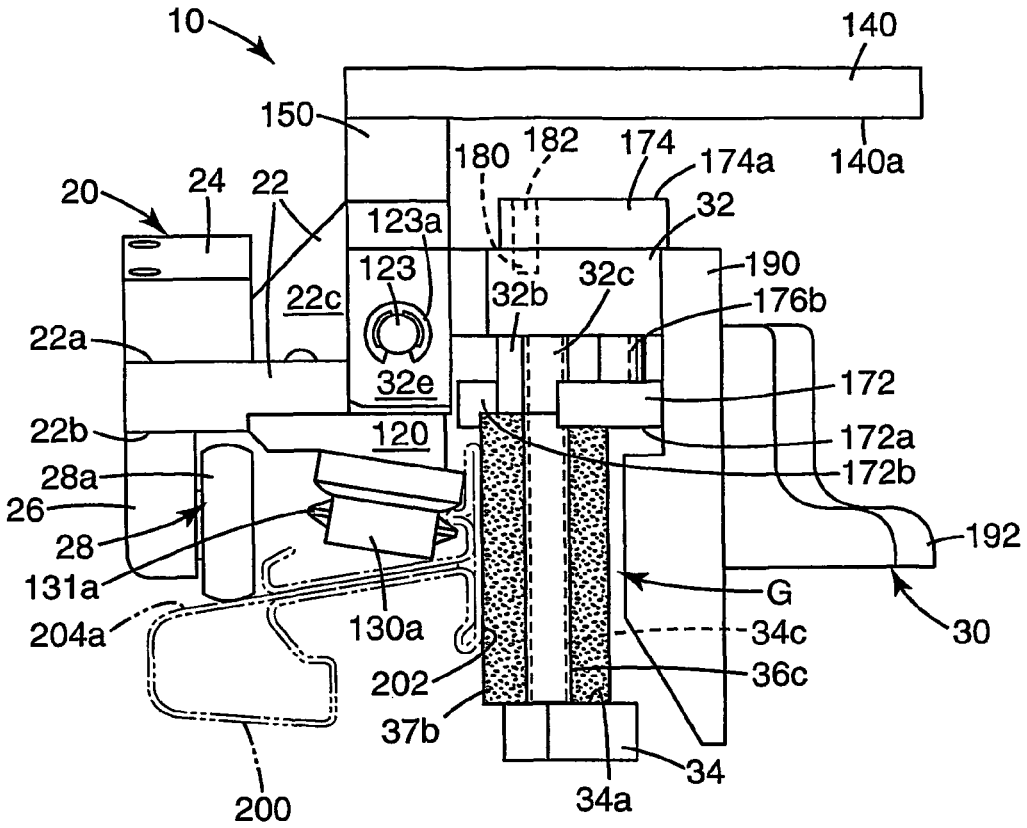
FIG. 9 is a side view similar to FIG. 2 but illustrating an opposite side of the tool.
Figure 10:
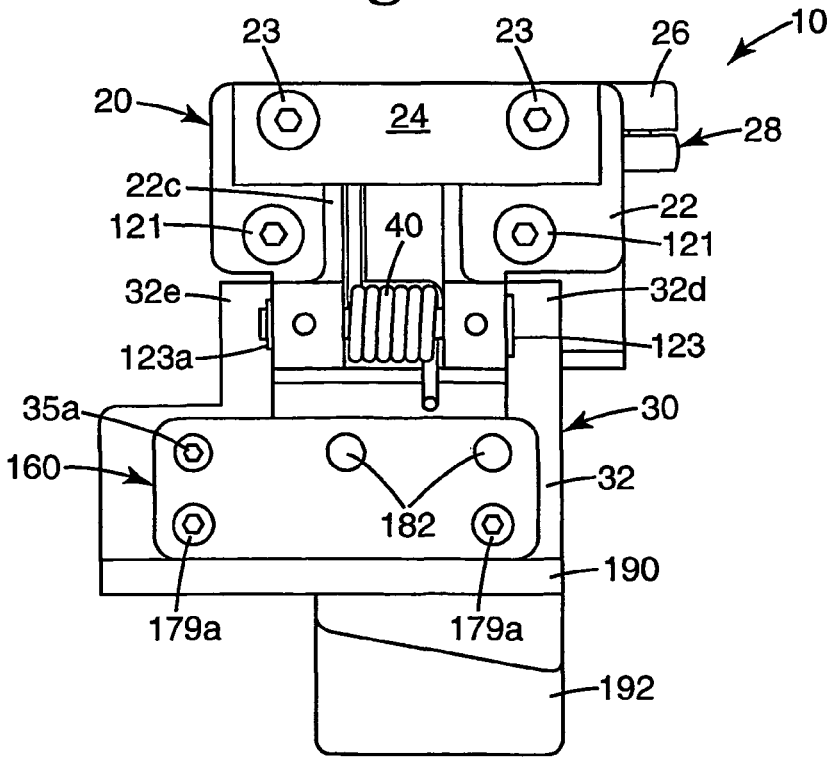
FIG. 10 is a top view of the tool of FIG. 1 with the lever removed.

The application structure 30 comprises a main body 32 and a lower guide 34, see FIG. 8, where elements comprising the application structure 30 are illustrated in exploded format. The main body 32 includes first and second projections 32*a*, 32*b*, a generally cylindrical projection 32*c* and downwardly extending arms 32*d* and 32*e*, see also FIGS. 2 and 9. A first axle 34*a* is positioned between the projection 32*a* and the lower guide 34, a second axle 34*b* is positioned between the projection 32*b* and the lower guide 34, and a third axle 34*c* is positioned between the cylindrical projection 32*c* and the lower guide 34. Bolts 35*a* pass through corresponding openings in the main body 32 and threadedly engage corresponding tapped openings in the axles 34*a*-34*c*. Bolts 35*b* pass through corresponding openings in the lower guide 34 and threadedly engage corresponding tapped openings in the axles 34*a*-34*c*. The axles 34*a*-34*c* do not rotate relative to the main body 32 and the lower guide 34. A roller core 36*a*-36*c* is fitted over each axle 34*a*-34*c* and rotates relative to its axle. An application roller 37*a* comprising a generally cylindrical foam member is fitted over core 36*a* so as to rotate with the core 36*a*. Similarly, an application roller 37*b* is fitted over core 36*b* so as to rotate with the core 36*b*. The application rollers 37*a* and 37*b* function as applying elements for pressing the adhesive-backed film 100 again the first surface 202 of the sash 200 during a film application operation.

A pin 38 is inserted into an opening in the main body 32 and an opening in the lower guide 34, see FIGS. 1 and 8. A set screw 38*b* holds the pin 38 in the main body 32. A generally cylindrical sleeve 38*a* made, for example, from a polymeric material, is fitted over the pin 38 and rotates relative to the pin 38. The sleeve 38*a* functions as a rotatable guide for the film 100 just before it is applied to the sash outer surface 202 by the application rollers 37*a* and 37*b*. The sleeve 38*a* also defines a sharp bend in the path along which the film 100 travels. By making a sharp bend at the sleeve 38*a*, the film 100 releases from a release liner 112, which is provided on the adhesive side of the film 100.

The application structure 30 further comprises a guide structure 160 for properly locating the adhesive-backed film 100 relative to the application rollers 37*a*, 37*b* and the sash first surface 202, see FIG. 8. The guide structure 160 comprises a guide assembly 170, which moves relative to the main body 32. The guide assembly 170 comprises a movable guide plate 172 having an inner surface 172*a* defining a movable guide surface, see FIGS. 1-3, an engagement bar 174, first and second slide rods 176*a*, 176*b* and a spring 178. The slide rods 176*a* and 176*b* pass through corresponding bores in the main body 32 and are fixedly coupled to the engagement bar 174 and the guide plate 172 via bolts 179*a* and 179*b*. The spring 178 is received in a recess in the main body 32 and contacts the engagement bar 174 so as to bias the guide assembly 170 to a second location, illustrated in FIG. 3, such that the movable guide surface 172*a* is located in a second position, which, as will be discussed below, corresponds to the second width $W_2$ of the film 100.

The guide structure 160 further comprises a pair of first magnetic elements 180 fixedly mounted in the main body 32 and a pair of second magnetic elements 182 fixedly mounted in the engagement bar 174. One or more of the magnetic elements 180, 182 may be replaced by a steel screw or bolt. The first and second magnetic elements 180 and 182 function to releasably couple the engagement bar 174 to the main body 32 when the guide assembly 170 is moved to a first location, illustrated in FIGS. 1 and 2, where the movable guide surface 172*a* is located in a first position, which, as will be discussed below, corresponds to the first width $W_1$ of the film 100. It is further contemplated that first and second mechanical connector elements may be provided in place of magnets 180 and 182. For example, hook and loop sections, such as Velcro™, may be provided on the main body 32 and the engagement bar 174 to releasably couple the engagement bar 174 to the main body 32 when the guide assembly 170 is moved to the first location. It is further contemplated that a conventional first connector element (not shown) such as a first leg may be provided on one of the main body 32 and the engagement bar 174 for being releasably received between second and third legs, spring-biased together, and defining a second connector element (not shown) provided on the other of the main body 32 and the engagement bar 174 to releasably couple the engagement bar 174 to the main body 32 when the guide assembly 170 is moved to the first location.

The guide structure 160 still further comprises a fixed guide surface 34*a* defined by an inner surface of the lower guide plate 34, which is spaced from and fixed in position relative to the main body 32. As is illustrated in FIGS. 1 and 2, the fixed guide surface 34*a* is spaced from the movable guide surface 172*a* by a distance substantially equal to the first width $W_1$ of the film 100 when the movable guide surface 172*a* is located in its first position. As illustrated in FIG. 3, the fixed guide surface 34*a* is spaced from the movable guide surface 172*a* by a distance substantially equal to the second width $W_2$ of the film 100 when the movable guide surface 172*a* is located in its second position.

The guide structure 160 also comprises an outer guide 190, which is spaced from the application rollers 37*a* and 37*b* so as to define a gap G for receiving the film 100 and the accompanying release liner 112. The guide 190 is coupled to the main body 32 via bolts 190*a*. An operator-gripping member 192 is fixedly coupled to the outer guide 190 via bolts 194.

The first and second projections 32*a*, 32*b* on the main body 32 have rounded portions facing the outer guide 190 so as to have shapes corresponding to the outer peripheries of the application rollers 37*a* and 37*b*.

Figure 4A:
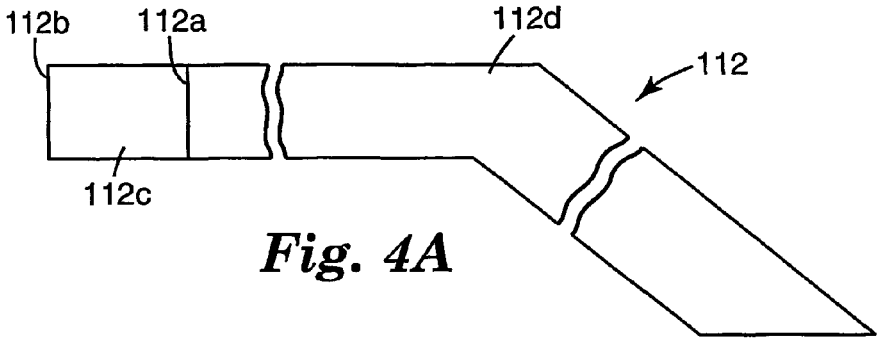
FIG. 4A is a side view of a release liner adapted to be joined to the film prior to the film being adhered to a sash.
Figure 11:
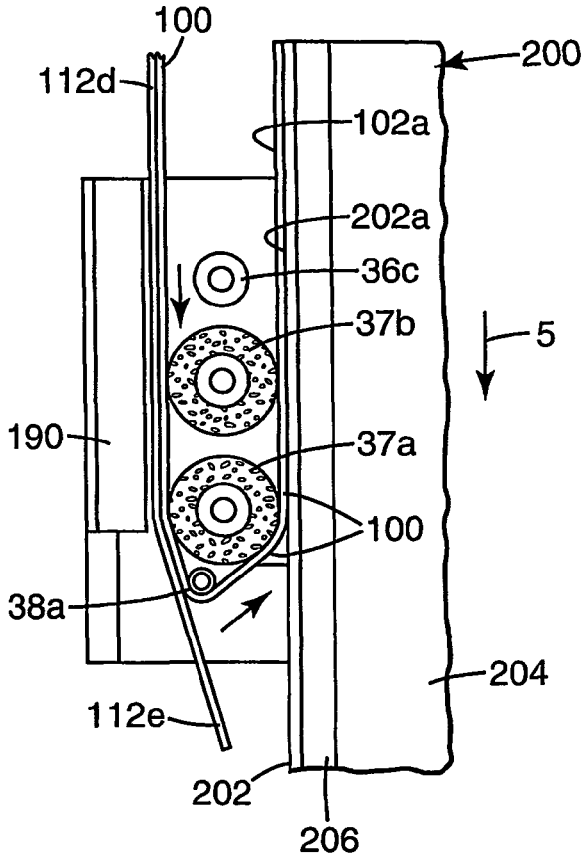
FIG. 11 is a schematic view illustrating the application of a film to a sash by application rollers of the tool of FIG. 1.
Figure 11A:
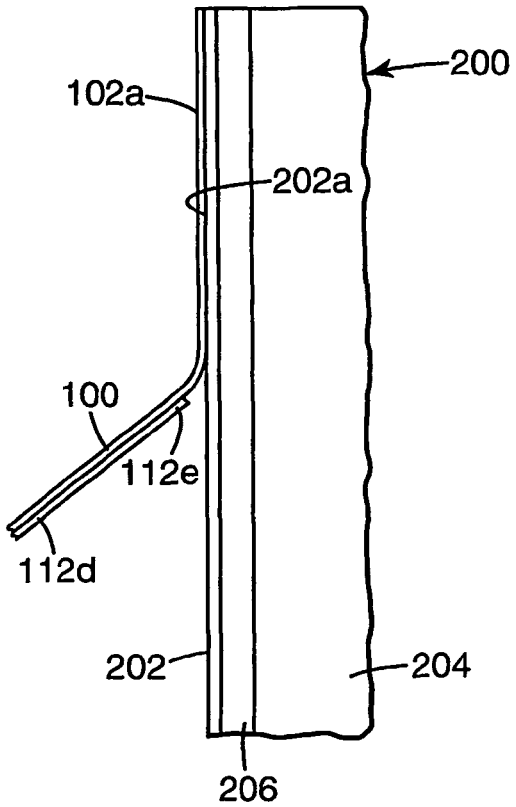
FIG. 11A is a view illustrating an initial portion of a film first section adhered to a beginning portion of a sash outer surface.

Application of the film 100 to the sash 200 via the tool 10 is effected as follows. As noted above and as illustrated in FIG. 11, a release liner 112 is provided on the adhesive side of the film 100. A score line 112*a* is provided in the release liner approximately 3 inches from a start edge 112*b* of the liner 112 so as to separate the liner into first and second sections 112*c* and 112*d*, see FIG. 4A. Initially, an operator manually removes the first section 112*c* of the release liner 112 from the film 100 such that the adhesive on an initial portion 102*a* of the film first section 102 is exposed. The operator then adheres the exposed adhesive-coated side of the initial film portion 102*a* to a corresponding beginning portion 202*a* of the outer surface 202 of the sash 200, see FIG. 11A.

Figure 2A:
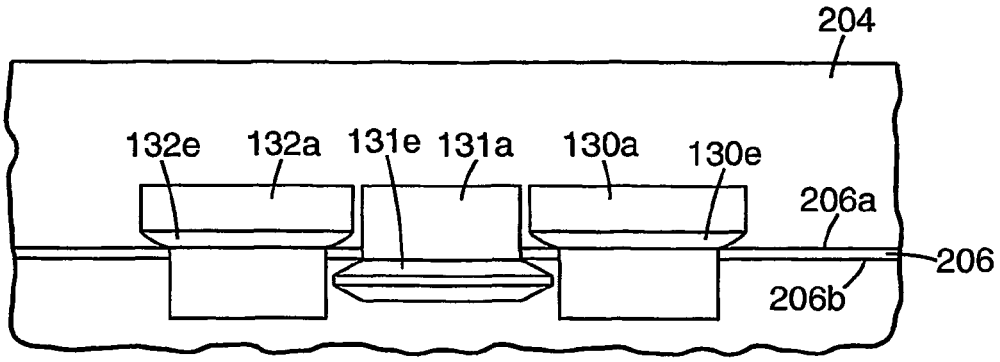
FIG. 2A is a view illustrating guide roller assemblies of the tool of FIG. 1 and the manner in which the rollers of those assemblies are positioned relative to a projecting rib of a sash.

Once the initial portion 102*a* of the film 100 has been adhered to the sash 200, the tool 10 is mounted to the sash 200 and over a portion of the film 100 having the release liner second section 112*d* adhered to it. To mount the tool 10 to the sash 200, the operator applies pressure to the lever 140 and outer gripping member 192 so as to separate the directing structure 20 from the application structure 30. The separated structures 20 and 30 are positioned over the sash 200 as illustrated in FIG. 1. The operator then releases pressure on the lever 140 and the outer gripping member 192 such that the directing and application structures 20 and 30 are clamped to the sash 200 with the rollers 130*a*-132*a* engaging the projecting rib 206 as illustrated in FIG. 2A.

Figure 11B:
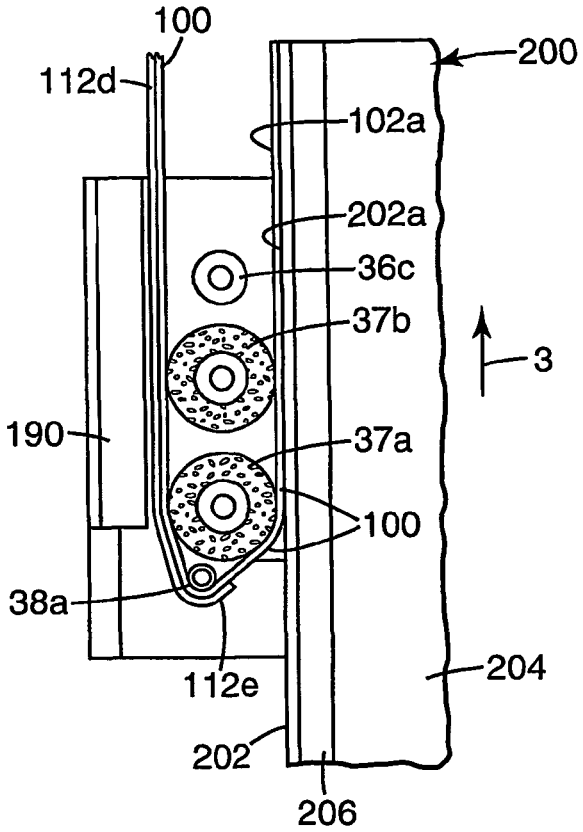
FIG. 11B is a schematic view illustrating the tool 10 moving backwards so as to allow an edge of a liner second section to separate from the film.

With the tool 10 mounted to the sash 200, the operator threads the film 100 having the release liner second section 112*d* attached to it around the cylindrical sleeve 38*a* and through the gap G between the outer guide 190 and the application rollers 37*a* and 37*b*. When so positioned, the release liner second section 112*d* faces the outer guide 190 while the film 100 faces the application rollers 37*a* and 37*b*. The tool 10 is then moved backwards in the direction of arrow 3 in FIG. 11B until an edge 112*e* of the liner second section 112*d* has separated from the film 100, see FIGS. 11B and 11. As the tool 10 is moved in the direction of arrow 3, an operator may have to pull the film 100/second section 112*d* in the direction of arrow 3 so as to take up slack in the film 100/second section 112*d*. Separation of the liner second section edge 112*e* typically occurs without operator intervention when the edge 112*e* has move at least to the position where it has traveled past the sleeve 38*a*. Once separation has occurred, the tool 10 is manually moved in the direction of arrow 5 in FIG. 11 so as to apply the film 100 to the sash 200. As the tool 10 moves in the direction of arrow 5, the release liner second section 112*d* continues to separate from the film 100. The film 100 is adhered to the sash outer surface 200 via pressure applied to the film 100 by the application rollers 37*a* and 37*b*.

In the embodiment illustrated in FIGS. 1-3, when the operator applies pressure to the lever 140 and the outer gripping member 192, a bottom surface 140*a* of the lever 140 engages a top surface 174*a* of the engagement bar 174 so as to apply a downward force onto the engagement bar 174 such that it moves toward the main body 32, see FIG. 1. When the engagement bar 174 nears the main body 32, the magnetic elements 180 and 182 attract one another resulting in the engagement bar 174 being moved into engagement with the main body 32 such that the guide assembly 170 is in its first location, see FIGS. 1 and 2. The magnetic elements 180 and 182 then function to releasably couple the engagement bar 174 to the main body 32. As noted above, when the guide assembly 170 is positioned in its first location, the movable guide surface 172*a* is located in its first position. As also noted above, when the movable guide surface 172*a* is in its first position, it is separated from the fixed guide surface 34*a* by a distance substantially equal to the first width $W_1$ of the film 100. When so positioned, the movable guide surface 172*a* and the fixed guide surface 34*a* function to properly locate the first section 102 of the film 100 relative to the application rollers 37*a* and 37*b* and the sash outer surface 202 as the film first section 102 travels through the gap G and is applied to the sash 200.

Figure 12:
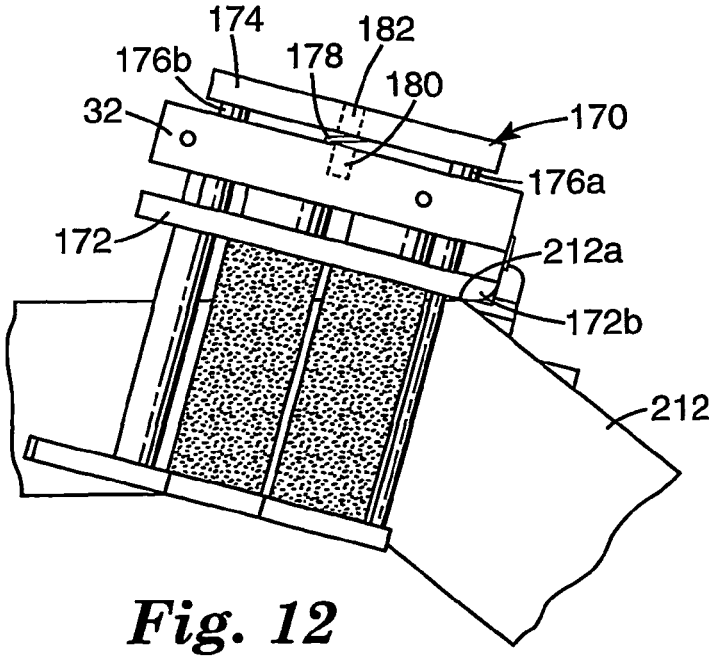
FIG. 12 is a view illustrating a movable guide plate engaging a corner on a sash such that the corner applies an upward force to the movable guide plate and wherein an outer guide and an operator-gripping member have been removed.

As noted above, the second section 104 of the film 100 has a second width $W_2$ greater than the first width $W_1$ of the film first section 102. Just before the film second section 104 is to be adhered to the sash outer surface 202, an extending portion 172*b* of the movable guide plate 172 engages the outer corner 212*a* of the sash angled portion 212, see FIGS. 6 and 12. With regard to the example sash 200 illustrated in FIG. 6, when the tool 10 has rotated at the corner 212*a* approximately 10 degrees to about 15 degrees from a horizontal axis 213, i.e., as it moves from the first substantially straight outer portion 210*a* to the second substantially straight outer portion 210*b*, the extending portion 172*b* engages the outer corner 212*a*. The outer corner 212*a* applies an upward force to the movable guide plate 172 sufficient to overcome the attractive forces generated by the magnetic elements 182 and 184 such that the movable guide plate 172 is moved toward the main body 32 while the engagement bar 174 is moved away from the main body 32, see FIG. 12. The spring 178 then acts to return the guide assembly 170 to its second location. As noted above, when the guide assembly 170 is in its second location, the movable guide surface 172*a* is in its second position, see FIG. 3, such that it is separated from the fixed guide surface 34*a* by a distance substantially equal to the second width $W_2$ of the film 100. When so positioned, the movable guide surface 172*a* and the fixed guide surface 34*a* function to properly locate the second section 104 of the film 100 relative to the application rollers 37*a* and 37*b* and the sash outer surface 202 as the film second section 104 travels through the gap G and is applied to the sash 200.

In the illustrated embodiment, the shape of the adhesive backed film 100 is made so as to have widths $W_1$ and $W_2$ greater than corresponding widths of the sash first and second outer surface portions 210*a* and 210*b*. After the tool 10 has applied the film 100, the extra width of the film 100 projects out from the edges of the sash 200, parallel to the outer surface 202 of the sash 200. This projecting film is later manually wrapped around the edges of the sash 200 and adhered to the second surface 204 of the sash 200. It is also contemplated that the shape of the adhesive backed film 100 may be made so as to have widths $W_1$ and $W_2$ substantially equal to the corresponding widths of the sash first and second outer surface portions 210*a* and 210*b*.

Figure 13:
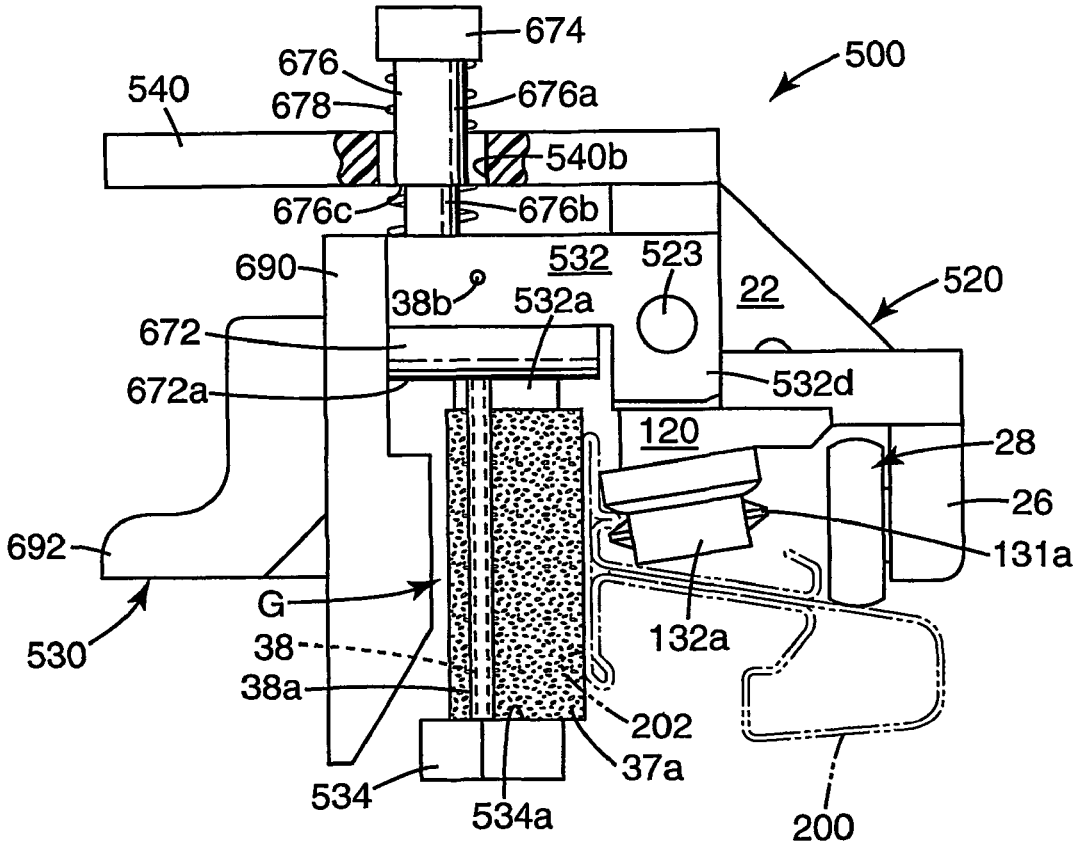
FIG. 13 is a side view of a tool constructed in accordance with a second embodiment of the present invention for applying an adhesive backed film to a sash and having a movable guide surface in a second position and with a portion of a lever removed.

A tool 500, constructed in accordance with a second embodiment of the present invention for applying an adhesive-backed film or tape 100 having multiple widths to an outer face of an adherend, is illustrated in FIG. 13, where like elements are referenced by like numerals.

Figure 14:
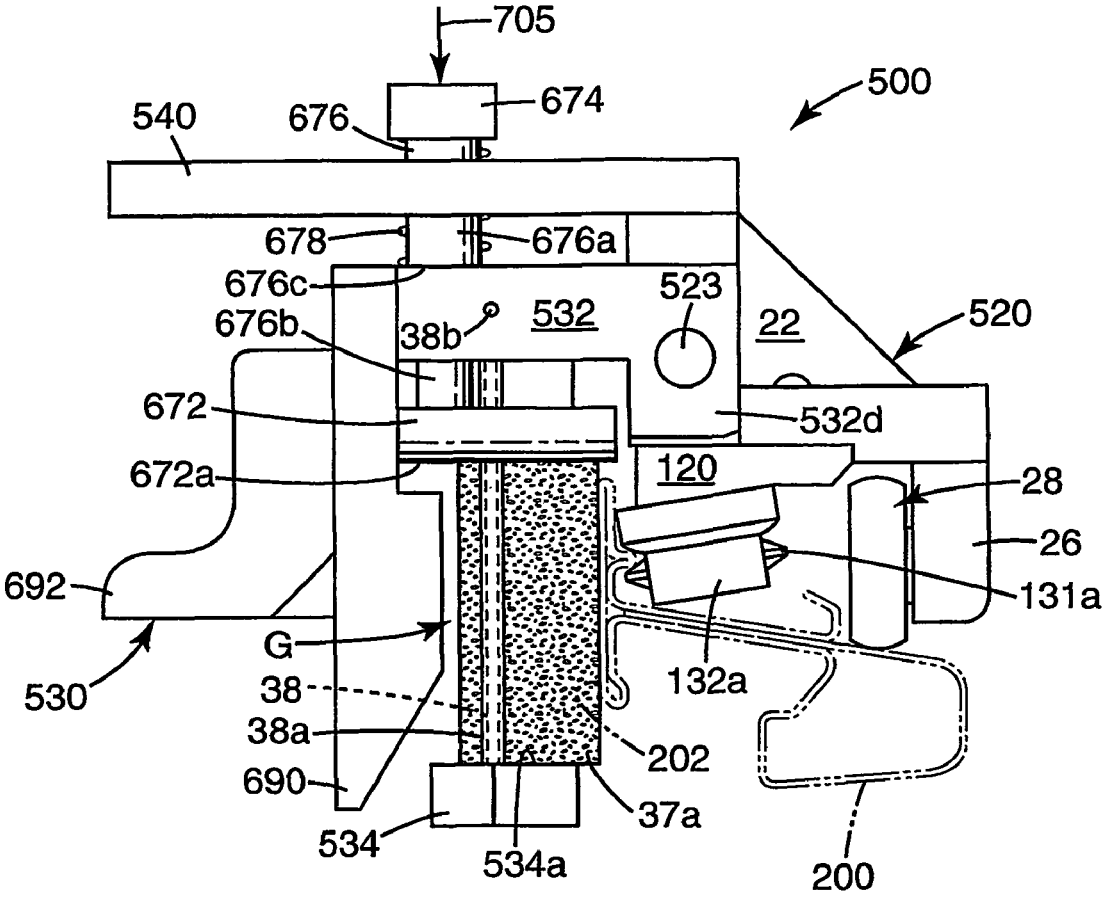
FIG. 14 is a side view of the tool of FIG. 13 illustrating the movable guide surface in a first position.
Figure 17:
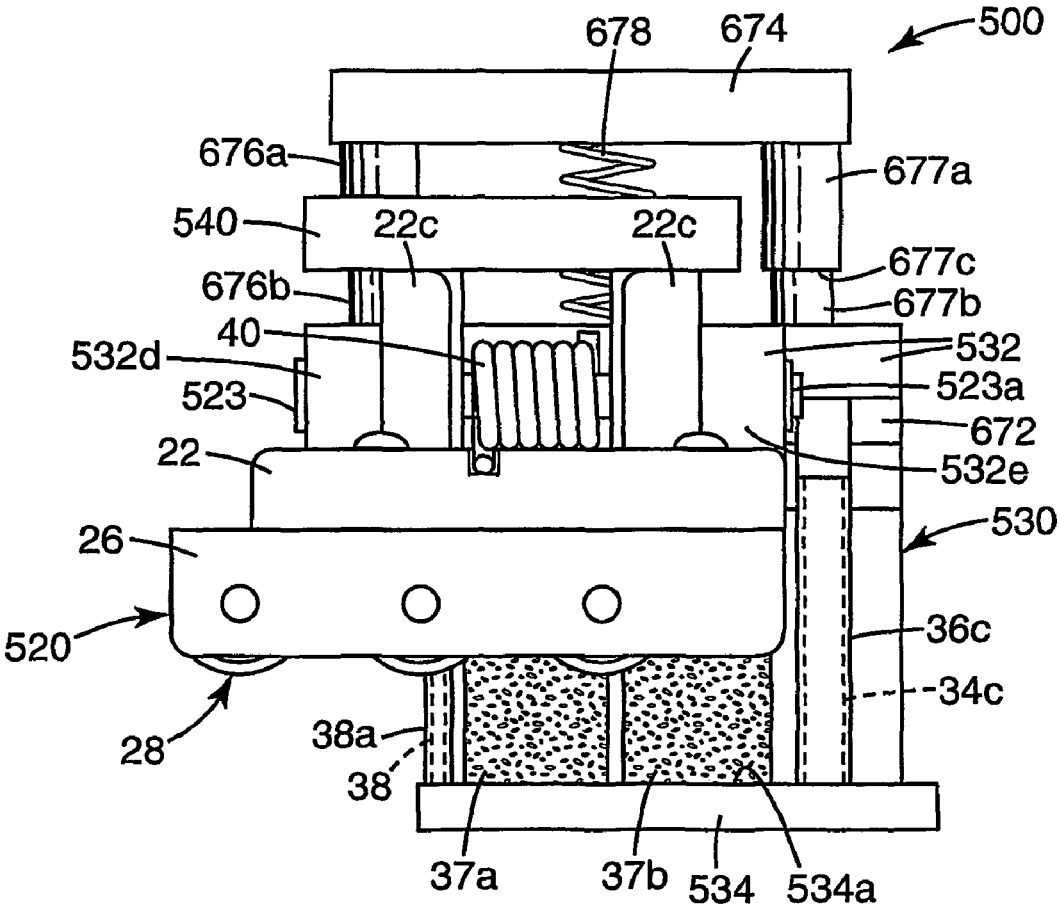
FIG. 17 is a view of a second end of the tool of FIG. 13.

The tool 500 comprises a directing structure 520 pivotably coupled to an application structure 530, see FIGS. 13 and 14. The directing and application structures 520 and 530 are pivotably coupled together via a pin 523. A retainer clip 523*a* coupled to an end of the pin 523 maintains the pin 523 in position relative to the directing and application structures 520 and 530. A spring 40, see FIG. 17, is provided for biasing the directing and application structures 520 and 530 toward one another such that the tool 500 can be releasably clamped to a sash 200, such as the one illustrated in FIGS. 5 and 6.

The directing structure 520 is constructed in essentially the same manner as the directing structure 20 of the embodiment of FIGS. 1-3, except for the following modifications. The directing structure 520 does not include a grip block 24, see FIGS. 13 and 14. Nor does the directing structure 520 include a lever spacer block 150, see FIGS. 13, 14 and 17. Rather, the lever 540 is mounted directly to the pivot block 22 via bolts (not shown). Further, the lever 540 is provided with a first bore (not shown) for receiving a spring 678 and a second bore 540*b* for receiving a first slide rod 676.

Figure 18:
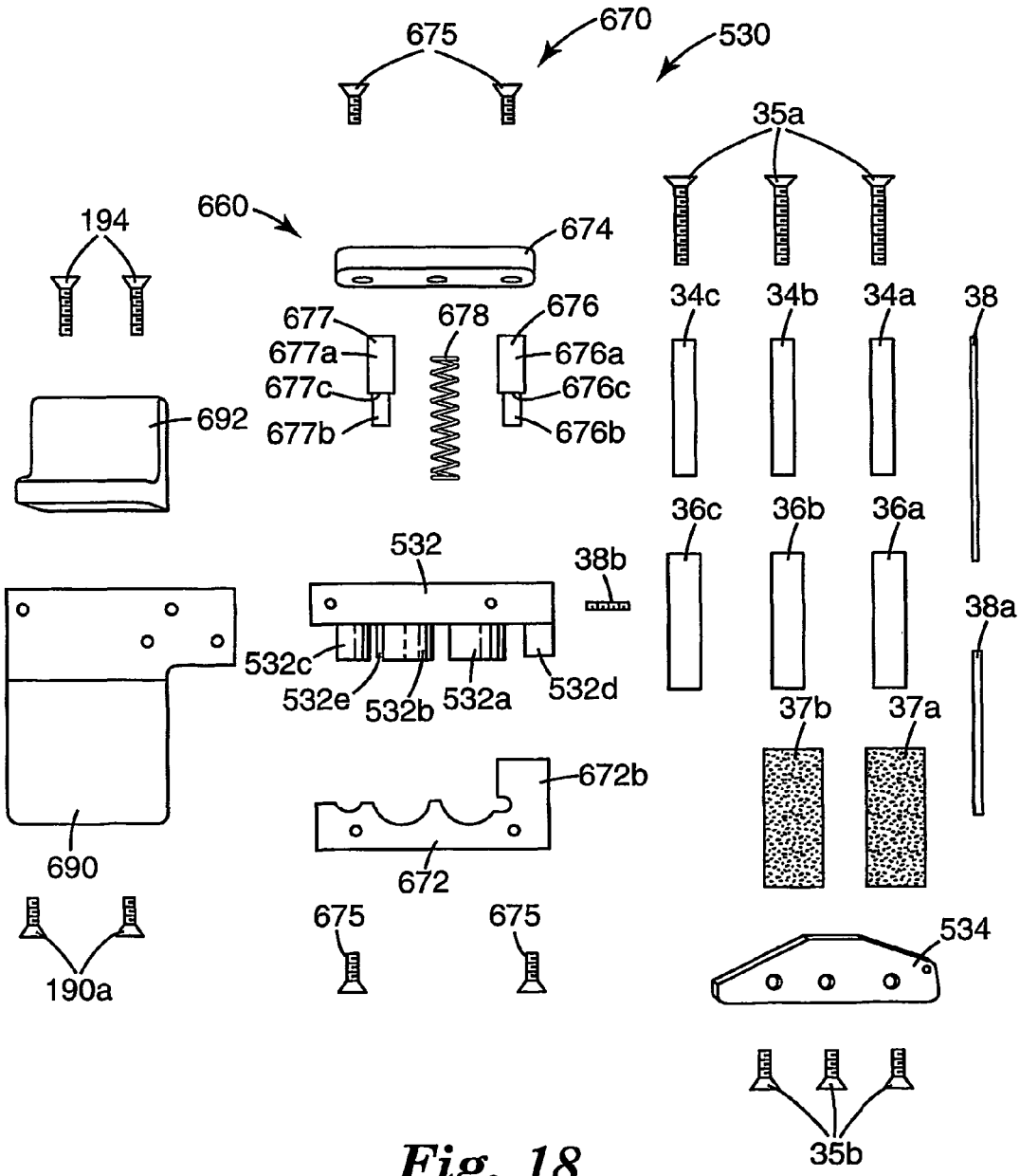
FIG. 18 is an exploded view of the application structure of the tool of FIG. 13.

The application structure 530 comprises a main body 532 and a lower guide 534, see FIG. 18, where elements comprising the application structure 530 are illustrated in exploded format. The main body 532 includes first and second projections 532*a*, 532*b*, a generally cylindrical projection 532*c* and downwardly extending arms 532*d* and 532*e*, see also FIGS. 13 and 17. A first axle 34*a* is positioned between the projection 532*a* and the lower guide 534, a second axle 34*b* is positioned between the projection 532*b* and the lower guide 534, and a third axle 34*c* is positioned between the cylindrical projection 532*c* and the lower guide 534. Bolts 35*a* pass through corresponding openings in the main body 532 and threadedly engage corresponding tapped openings in the axles 34*a*-34*c*. Bolts 35*b* pass through corresponding openings in the lower guide 534 and threadedly engage corresponding tapped openings in the axles 34*a*-34*c*. The axles 34*a*-34*c* do not rotate relative to the main body 532 and the lower guide 534. A roller core 36*a*-36*c* is fitted over each axle 34*a*-34*c* and rotates relative to its axle. An application roller 37*a* comprising a generally cylindrical foam member is fitted over core 36*a* so as to rotate with the core 36*a*. Similarly, an application roller 37*b* is fitted over core 36*b* so as to rotate with the core 36*b*. The application rollers 37*a* and 37*b* function as applying elements for pressing the adhesive-backed film 100 again the first surface 202 of the sash 200 during a film application operation.

A pin 38 is inserted into an opening in the main body 532 and an opening in the lower guide 534, see FIG. 14. A set screw 38*b* holds the pin 38 in the main body 532. A generally cylindrical sleeve 38*a* made, for example, from a polymeric material, is fitted over the pin 38 and rotates relative to the pin 38. The sleeve 38*a* functions as a rotatable guide for the film 100 just before it is applied to the sash outer surface 202 by the application rollers 37*a* and 37*b*.

Figure 16:
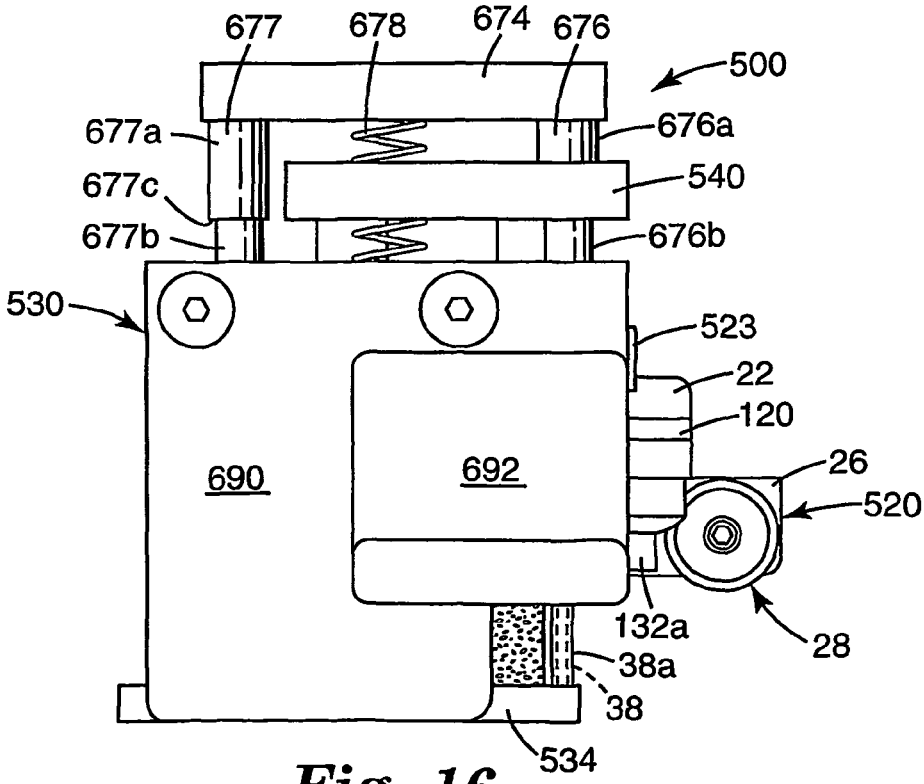
FIG. 16 is a view of a first end of the tool of FIG. 13.

The application structure 530 further comprises a guide structure 660 for properly locating the adhesive-backed film 100 relative to the application rollers 37*a*, 37*b* and the sash first surface 202, see FIG. 18. The guide structure 660 comprises a guide assembly 670, which is manually movable relative to the main body 532. The guide assembly 670 comprises a movable guide plate 672 having an inner surface 672*a* defining a movable guide surface, see FIGS. 13 and 14, an engagement bar 674, first and second slide rods 676 and 677 and a spring 678. As noted above, the first slide rod 676 passes through the bore 540*b* in the lever 540. As is apparent from FIG. 16, the second slide rod 677 does not pass through a bore in the lever 540.

The first slide rod 676 has a first portion 676*a* having a first diameter and a second portion 676*b* having a second diameter which is smaller than the first diameter such that a stepped portion 676*c* is defined where the first and second portions 676*a* and 676*b* meet. The second portion 676*b* also passes through a first bore (not shown) in the main body 532, which bore is sized so as to be only slightly larger than the second diameter of the second portion 676*b*, but is smaller than the first diameter of the first portion 676*a*. Hence, the portion of the main body 532 surrounding the main body first bore defines a stop or limit surface which limits the movement of the first slide rod 676 relative to the main body 532.

The second slide rod 677 has a third portion 677*a* having a third diameter and a fourth portion 677*b* having a fourth diameter which is smaller than the third diameter such that a stepped portion 677*c* is defined where the third and fourth portions 677*a* and 677*b* meet. The fourth portion 677*b* passes through a second bore (not shown) in the main body 532, which bore is sized so as to be only slightly larger than the fourth diameter of the fourth portion 677*b*, but is smaller than the third diameter of the third portion 677*a*. Hence, the portion of the main body 532 surrounding the main body second bore defines a stop or limit surface which limits the movement of the second slide rod 677 relative to the main body 532.

The slide rods 676 and 677 are fixedly coupled to the engagement bar 674 and the guide plate 672 via bolts 675. The spring 678 is received in a recess in the main body 532, passes through a bore in the lever 540 and contacts the engagement bar 674 so as to bias the guide assembly 670 to a second location, illustrated in FIG. 13, such that the movable guide surface 672*a* is located in a second position, which corresponds to the second width $W_2$ of the film 100.

An operator may press down on the engagement bar 674, as designated by arrow 705 in FIG. 14, so as to move the guide assembly 670 against the upward bias force of the spring 40 to a first location, illustrated in FIG. 14, where the movable guide surface 672*a* is located in a first position, which corresponds to the first width $W_1$ of the film 100. The first location of the guide assembly 670 is defined by the slide rod stepped portions 676*c* and 677*c* engaging the limit surfaces of the main body 532 surrounding the main body first and second bores.

The guide structure 660 still further comprises a fixed guide surface 534*a* defined by an inner surface of the lower guide plate 534, which is spaced from and fixed in position relative to the main body 532, see FIGS. 13 and 17. As is illustrated in FIG. 14, the fixed guide surface 534*a* is spaced from the movable guide surface 672*a* by a distance substantially equal to the first width $W_1$ of the film 100 when the movable guide surface 672*a* is located in its first position. As illustrated in FIG. 13, the fixed guide surface 534*a* is spaced from the movable guide surface 672*a* by a distance substantially equal to the second width $W_2$ of the film 100 when the movable guide surface 672*a* is located in its second position.

The guide structure 660 also comprises an outer guide 690, which is spaced from the application rollers 37*a* and 37*b* so as to define a gap G for receiving the film 100 and an accompanying release liner 112. The guide 690 is coupled to the main body 32 via bolts 190*a*. An operator-gripping member 692 is coupled to the outer guide 690 via bolts (not shown).

Application of the film 100 to the sash 200 via the tool 500 is effected as follows. As discussed above with regard to tool 10, an operator manually removes the first section 112*c* of the release liner 112 from the film 100 such that the adhesive on an initial portion 102*a* of the film first section 102 is exposed. The operator then adheres the exposed initial film portion 102*a* to a corresponding beginning portion 202*a* of the outer surface 202 of the sash 200, see FIG. 11A.

Once the initial portion 102*a* of the film 100 has been adhered to the sash 200, the tool 500 is mounted to the sash 200 and over a portion of the film 100 having the release liner second section 112*d* adhered to it. To mount the tool 500 to the sash 200, the operator applies pressure to the lever 540 and outer gripping member 692 so as to separate the directing structure 520 from the application structure 530. The separated structures 520 and 530 are positioned over the sash 200. The operator then releases pressure on the lever 540 and the outer gripping member 692 such that the directing and application structures 520 and 530 are clamped to the sash 200 with the rollers 130*a*-132*a* engaging the projecting rib 206 as illustrated in FIG. 2A.

With the tool 500 mounted to the sash 200, the operator threads the film 100 having the release liner second section 112*d* attached to it around the cylindrical sleeve 38*a* and through the gap G between the outer guide 690 and the application rollers 37*a* and 37*b*. When so positioned, the release liner second section 112*d* faces the outer guide 690 while the film 100 faces the application rollers 37*a* and 37*b*. The tool 500 is then moved backwards, i.e., towards the beginning portion 202*a* of the sash outer surface 202, until an edge 112*e* of the liner second section 112*d* has separated from the film 100. As the tool 500 is moved backwards, an operator may have to pull the film 100/second section 112*d* in the direction of movement of the tool 500 so as to take up slack in the film 100/second section 112*d*. Separation of the liner second section edge 112*e* typically occurs without operator intervention when the edge 112*e* has move at least to the position where it has traveled past the sleeve 38*a*. Once separation has occurred, the tool 500 is manually moved in a direction away from the beginning portion 202*a* of the sash outer surface 202 so as to apply the film 100 to the sash 200.

Figure 15:
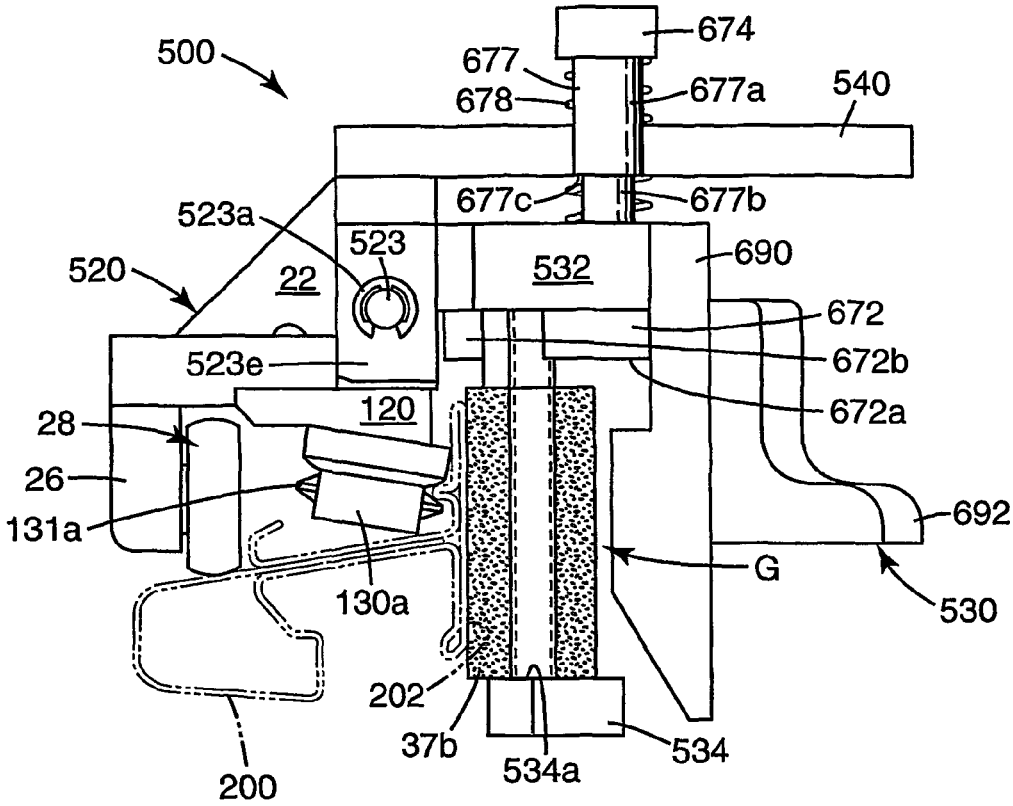
FIG. 15 is a side view similar to FIG. 13 but illustrating an opposite side of the tool.

In the embodiment illustrated in FIGS. 13-15, as the tool 500 is applying the film first section 102 to the sash outer surface 202, an operator must apply a downward force to the engagement bar 674 such that the guide assembly 670 is positioned in its first location. When so positioned, the movable guide surface 672*a* is located in its first position. As noted above, when the movable guide surface 672*a* is in its first position, it is separated from the fixed guide surface 534*a* by a distance substantially equal to the first width $W_1$ of the film 100. When so positioned, the movable guide surface 672*a* and the fixed guide surface 534*a* function to properly locate the first section 102 of the film 100 relative to the application rollers 37*a* and 37*b* and the sash outer surface 202 as the film first section 102 travels through the gap G and is applied to the sash 200.

As noted above, the second section 104 of the film 100 has a second width $W_2$ greater than the first width $W_1$ of the film first section 102. Just before the film second section 104 is to be adhered to the sash outer surface 202, the operator removes the downward force he/she is applying to the engagement bar 674 such that the spring 678 acts to return the guide assembly 670 to its second location. As noted above, when the guide assembly 670 is in its second location, the movable guide surface 672*a* is in its second position, see FIG. 13, such that it is separated from the fixed guide surface 534*a* by a distance substantially equal to the second width $W_2$ of the film 100. When so positioned, the movable guide surface 672*a* and the fixed guide surface 534*a* function to properly locate the second section 104 of the film 100 relative to the application rollers 37*a* and 37*b* and the sash outer surface 202 as the film second section 104 travels through the gap G and is applied to the sash 200.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention. For example, it is contemplated that the tools of the present invention could be used to apply films to articles other than vehicle sashes such as appliances, tools, etc.

We claim:

1. An adhesive-backed film application tool for applying an adhesive-backed film to a first surface of an adherend, said adherend further including a second surface, said tool comprising:

a directing structure adapted to engage said second surface of said adherend;

an application structure coupled to said directing structure;

an element for biasing said directing and application structures toward one another such that said directing and application structures are capable of being releasably clamped to said adherend;

said application structure including at least one element for applying the adhesive-backed film to said first surface, guide structure for properly locating said adhesive-backed film relative to said applying element and said first surface, and a main body, said guide structure having a movable guide surface capable of being located in a first position corresponding to a first dimension of said adhesive-backed film and a second position corresponding to a second dimension of said adhesive-backed film, said guide structure comprising a guide assembly which is movable relative to said main body; and releasably coupling structure for releasably coupling said movable guide surface in said first position, wherein said guide assembly comprises:

a guide plate having a surface defining said movable guide surface;

an element for biasing said guide surface toward said second position;

an engagement bar;

at least one slide rod passing through a bore in said main body and being fixedly coupled to said engagement bar and said guide plate; and a spring defining said biasing element, engaging said engagement bar and biasing said engagement bar and said guide plate to a second location such that said movable guide surface is located in said second position.

2. An adhesive-backed film application tool as set forth in claim 1, wherein said directing structure comprises a lever which is capable of engaging said engagement bar to move said engagement bar against said spring such that said engagement bar and said guide plate are moved to a first location where said movable guide surface is located in said first position.

3. An adhesive-backed film application tool as set forth in claim 1, wherein said releasably coupling structure comprises a first magnetic element and a second magnetic element, said first and second magnetic elements releasably coupling said engagement bar to said main body when said engagement bar and said guide plate are moved to a first location.

4. An adhesive-backed film application tool as set forth in claim 3, wherein said guide plate comprises a section which engages a portion of said adherend approximately where said first surface of said adherend changes widths, said adherend portion causing said guide plate to move toward said main body while said engagement bar moves away from said main body such that said first and second magnetic elements are separated sufficiently to allow said spring to move said engagement bar and said guide plate to said second location.

5. An adhesive-backed film application tool as set forth in claim 1, wherein said releasably coupling structure comprises a first connector element and a second connector element, said second connector element being releasably engageable with said first connector element so as to releasably couple said engagement bar to said main body when said engagement bar and said guide plate are moved to a first location.

6. An adhesive-backed film application tool for applying an adhesive-backed film having at least first and second widths to a first surface of an adherend, said adherend further including a second surface, said tool comprising:

a directing structure adapted to engage said second surface of said adherend;

an application structure pivotably coupled to said directing structure, with said application structure comprising:

at least one element for applying the adhesive-backed film to said first surface, guide structure for properly locating said adhesive-backed film relative to said element and said first surface, and a main body, wherein said guide structure has a manually movable guide surface capable of being located in a first position corresponding to said first width of said adhesive-backed film and a second position corresponding to said second width of said adhesive-backed film, said guide structure comprising a guide assembly which is movable relative to said main body; and an element for biasing said directing and application structures toward one another such that said directing and application structures are capable of being releasably clamped to said adherend, wherein said guide assembly comprises:

a guide plate having a surface defining said movable guide surface;

an element biasing said guide surface toward said second position;

an engagement bar;

at least one slide rod passing through a bore in said main body and being fixedly coupled to said engagement bar and said guide plate; and a spring defining said biasing element, engaging said engagement bar and biasing said engagement bar and said guide plate to a second location such that said movable guide surface is located in said second position.

7. An adhesive-backed film application tool as set forth in claim 6, wherein said engagement bar is capable of being manually engaged to move said engagement bar against said spring such that said engagement bar and said guide plate are moved to a first location where said movable guide surface is located in said first position.

* * * * *

UNITED STATES PATENT AND TRADEMARK OFFICE

CERTIFICATE OF CORRECTION

PATENT NO. : 8,002,009 B2
APPLICATION NO. : 10/595213
DATED : August 23, 2011
INVENTOR(S) : Gordon L Anderson It is certified that error appears in the above-identified patent and that said Letters Patent is hereby corrected as shown below:

On the Title Page, left column under "Prior Publication Data" add:

Item -- (60) Related U.S. Application Data

Provisional application No. 60/507,273, filed on September 30, 2003 --.

Col. 3, line 44, after "210a" insert -- . --.

Col. 4, line 35, delete "PCT/JUS03/09263," and insert -- PCT/US03/09263, --.

Signed and Sealed this
Twenty-second Day of November, 2011

David J. Kappos

David J. Kappos
*Director of the United States Patent and Trademark Office*